US005195261A

United States Patent [19]

Vachon

[11] Patent Number: 5,195,261

[45] Date of Patent: Mar. 23, 1993

[54] QUICK-HITCHING DEVICE FOR DETACHABLY MOUNTING AN ATTACHMENT TO A VEHICLE FRAME

[76] Inventor: Bertrand Vachon, 2796 chemin de l'Aéroport, Thetford Mines, Quebec, Canada, G6G 5R7

[21] Appl. No.: 868,963

[22] Filed: Apr. 16, 1992

[51] Int. Cl.[5] ..... E01H 5/04

[52] U.S. Cl. ..... 37/231; 37/234; 37/236; 37/271

[58] Field of Search ..... 37/231, 234, 235, 236, 37/266, 279, 270, 271

[56] References Cited

U.S. PATENT DOCUMENTS

| | | | |
|---|---|---|---|
| 3,769,724 | 11/1973 | Norgaard . | |
| 3,845,577 | 11/1974 | Naymik . | |
| 4,236,329 | 12/1980 | Hetrick . | |
| 4,244,122 | 1/1981 | Hetrick | 37/236 X |
| 4,279,084 | 7/1981 | Low et al. . | |
| 4,320,589 | 3/1982 | Pelazza . | |
| 4,342,163 | 8/1982 | Hoekstra | 37/231 |
| 4,619,060 | 10/1986 | Knowlton | 37/231 |
| 5,036,608 | 8/1991 | Ciula . | |
| 5,075,988 | 12/1991 | Ciula | 37/234 X |

FOREIGN PATENT DOCUMENTS

| | | |
|---|---|---|
| 1153885 | 9/1983 | Canada . |
| 12766784 | 11/1990 | Canada . |

*Primary Examiner*—Randolph A. Reese
*Assistant Examiner*—J. Russell McBee
*Attorney, Agent, or Firm*—ROBIC

[57] ABSTRACT

A quick hitching device for detachably mounting an attachment such as a snow plow or a rotary brush to the frame of a road vehicle. The device comprises a quick hitching sub-frame that is detachably connectable to the bottom of the frame of the vehicle, and tiltable with respect to this frame about a first transversal pivot when its rear end is not connected. The device also comprises an attachment supporting sub-frame having a rear end hingedly connected to the hitching sub-frame about a second transversal axis parallel to the first axis, and a longitudinal extensible power jack having one end pivotably attached to the front portion of the hitching sub-frame above the second axis and another end pivotably attached to the front end of the supporting sub-frame. This power jack is actuable to cause the supporting sub-frame to be tilted up and down with respect to the hitching sub-frame between a first extreme position where both of the sub-frames are folded to form an inverted V, with the second transversal axis extending above the ground, and a second extreme position where the hitching sub-frame is fully connected to the vehicle frame and the supporting sub-frame is tilted up to lift up the attachment mounted thereon in an inactive position, the attachment being in active position between these first and second extreme positions. Thus, the device is made in such a way that it lifts up and lowers by itself to reach the vehicle frame and move down from the same. One person only may, without effort and tools and in a very short time, connect or disconnect the hitching sub-frame, thereby eliminating the weight of a permanent attachment.

13 Claims, 6 Drawing Sheets

QUICK-HITCHING DEVICE FOR DETACHABLY MOUNTING AN ATTACHMENT TO A VEHICLE FRAME

BACKGROUND OF THE INVENTION

1. Field of the Invention

The present invention relates to a quick-hitching device for detachably mounting in a quick and very efficient manner, a vehicle attachment such as a snowplow, to the frame of a road vehicle, preferably a 2 or 4 wheel drive vehicle.

2. Brief Description of the Prior Art

Various methods and devices have been proposed in the last decades for detachably mounting a snow plow to the front of a truck. See, by way of examples, Canadian Patent Nos. 1,153,885 and 1,276,784 and U.S. Pat. Nos. 3,769,724; 3,845,577; 4,236,329; 4,279,084; 4,320,589; 4,744,159; 4,769,933; 5,027,536 and 5,036,608.

Generally, the known devices comprise a framework that is detachably connectable to the frame of the truck. The snow plow is detachably mounted in pivotably adjustable manner onto the front of the frame of the vehicle so as to transfer the plowing force directly to this framework. A hydraulic cylinder is provided for moving the plow from its plowing position to a raised position. This cylinder is generally secured to the frame of the truck with mounting brackets and arms extending therefrom and to which are attached chains or other means for lifting the plow blade out of contact with the ground.

When the plow blade is removed from the device the hydraulic cylinder and the arms and brackets used to secure it are left connected to the truck and extend forward of the bumper of the truck in a postition where they can be a hazard to another vehicle or building in the case of a contact with the truck's bumper.

The known devices also have the disadvantage of requiring a bulky attachment frame permanently secured to the truck, for use to connect the device. This attachment frame often creates encumbrance to the vehicle when the snow plow is not attached thereto, and it adds to the weight of the vehicle, thereby increasing its fuel consumption. Further, it often damages the vehicle frame to which it is permanently attached.

Another disadvantage of the known devices is that the attachment frame permanently secured to the truck often requires to be dismantled at least in part when certain repairs are required to the vehicle front end. In many cases, such a partial dismantling is even required when one has to lift the hood of the vehicle, which is of common occurrence.

Still a further disadvantage of the known devices using a snow plow attachment frame is that it is time consuming to attach a snow plow thereto and it normally requires the assistance of at least two men to perform the installation.

OBJECTS OF THE INVENTION

A first object of the present invention is to provide a universal quick hitching device to detachably mount an attachment to the frame of a road vehicle.

Another object of the invention is to provide a device of the above type, which is very simplified and very easy to install as compared to the existing device.

A further object of the invention is to provide a device of the above type, which is so designed as to reduce the time required to mount and remove the attachment.

Still another object of the invention is to provide a device of the above type, which requires only one operator to mount and remove the attachment to and from the vehicle.

Still another object of the invention is to provide a device of the above type, wherein the appearance of the vehicle is not permanently deteriorated by a front attachment frame and a deplaced bumper.

Still a further object of the invention is to provide a device of the above type, including a permanent attachment frame which does not extend forward at the front of the vehicle, thereby decreasing the safety hazards.

SUMMARY OF THE INVENTION

In accordance with the invention, the above objects are achieved with a quick hitching device for detachably mounting an attachment such as a snow plow or a rotary brush to the frame of a road vehicle, the device comprising:

a) a quick hitching sub-frame detachably conectable to the frame of the vehicle, this quick hitching sub-frame having a rear portion including longitudinally spaced-apart front and rear hitching means detachably connectable to the bottom of the vehicle frame, the quick hitching sub-frame being tiltable with respect to the vehicle frame about a first transversal axis when the front hitching means are connected to the vehicle frame but the rear h itching means is not, the hitching sub-frame also having a front portion projecting up vertically in front of the rear portion;

b) an attachment supporting sub-frame having a rear end hingedly connected to the rear portion of the hitching sub-frame, in front of he front hitching means, about a second transversal axis parallel to the frist transversal axis, the supporting frame having a front end including means for mounting the attachment; and c) a longitudinal extensible power jack having one end pivotably atached to the front portion of the hitching sub-frame above the second transversal axis, and another end pivotably attached to the front end of the supporting sub-frame, the power jack being actuable to cause the supporting sub-frame to be tilted up and down with respect to the hitching sub-frame between a first extreme position where both of the sub-frames are folded to form an inverted V, with the second transversal axis extending above the ground and the front hiching means extending up to the frame of the vehicle, and a second extreme position where the hitching sub-frame is fully connected to the vehicle frame and the supporting sub-frame is tilted up to lift up the attachment mounted thereon in an inactive position, the attachment being in active position between said first and second extreme positions.

The device according to the invention is made in such a way that it lifts up and lowers by itself to reach the vehicle frame and move down from the same. Thus, one person only may without effort and tools and in a very short time, connect or disconnect this quick-hitching device to or from the vehicle frame, thereby eliminating the weight of a permanent attachment and avoiding any deterioration to the appearance of the vehicle.

The invention, its operation and its advantages will be better understood upon reading of the following non-restrictive description of a preferred embodiment thereof, given with reference to the accompanying drawing.

DESCRIPTION OF A PREFERRED EMBODIMENT

The quick hitching device 1 according to the invention as shown in the accompanying drawings is intented to be used for detachably mounting an attachment such as a snow plow 3 to the frame 5 of a road vehicle V, such as a 4×4 or a pick-up.

Figure 2:
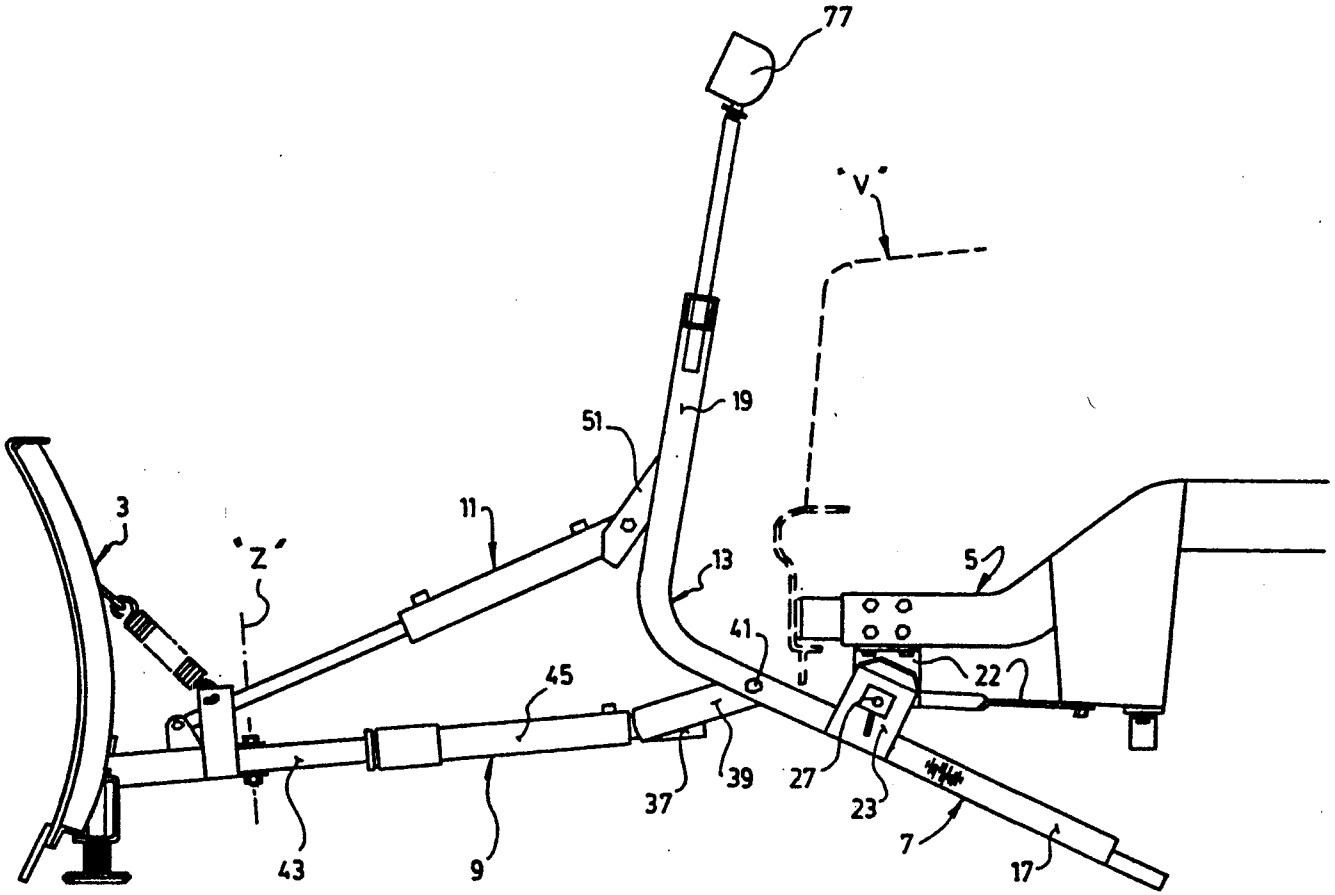
FIG. 2 is a side elevational view of the quick-hitching device of FIG. 1 in another extreme position.
Figure 3:
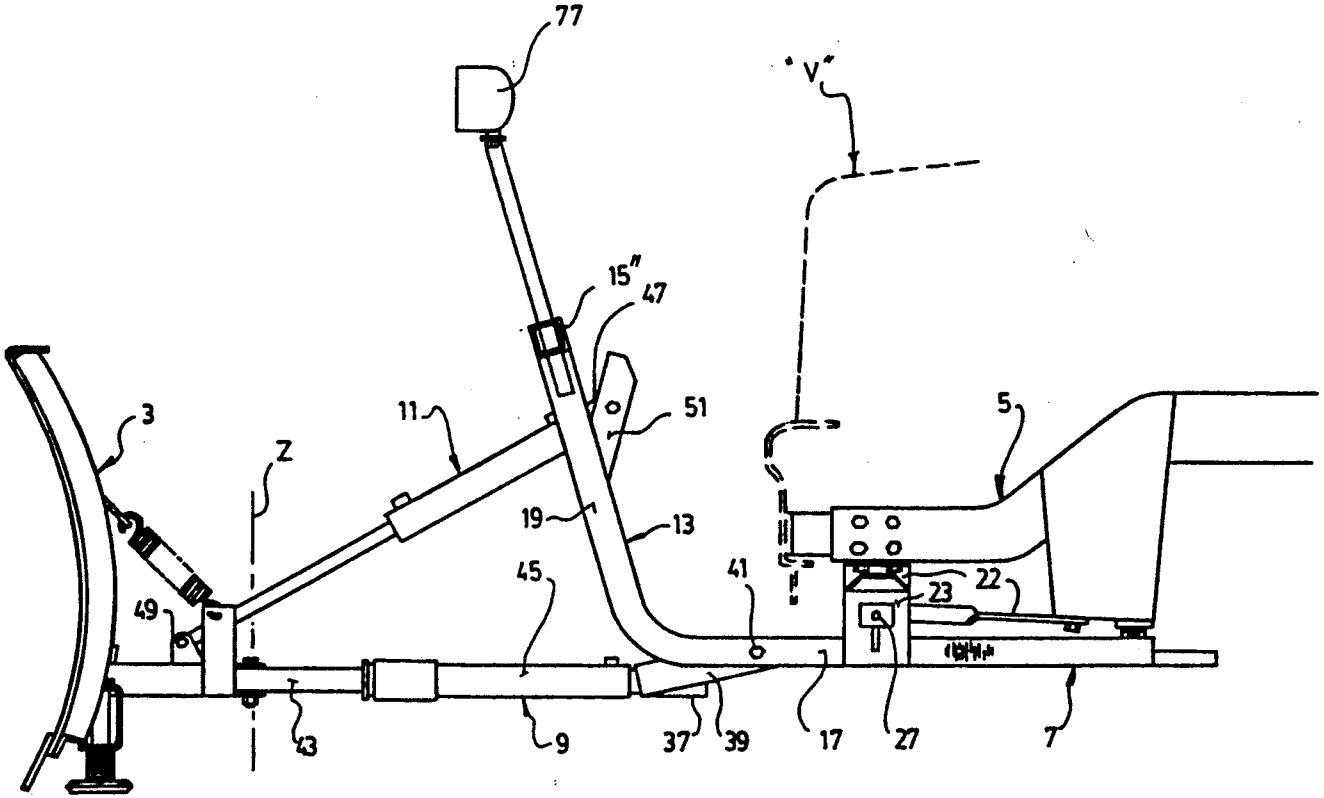
FIG. 3 is a side elevational view of the quick-hitching device of FIG. 1 in another extreme position.
Figure 4:
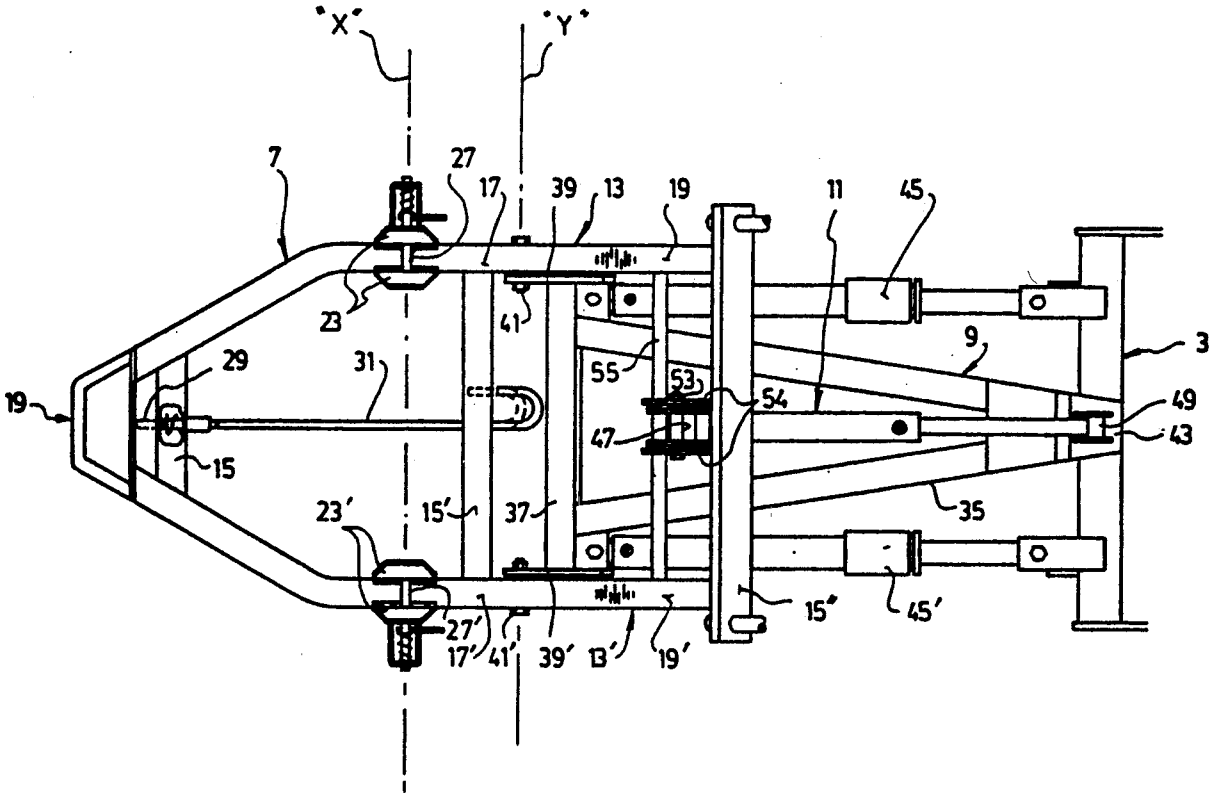
FIG. 4 is a top plan view showing the supporting and hitching sub-frames of the quick-hitching device shown in FIGS. 1 to 3; its supporting and hitching sub-frames.

As better shown in FIGS. 2 to 4, the device 1 basically comprises a quick hitching sub-frame 7 detachably connectable under the frame 5 of the vehicle V, an attachment supporting sub-frame 9 hingedly connected to the front of the hitching sub-frame 7, and a longitudinally extensible power jack 11 operatively attached to both sub-frames 7, 9 in order to tilt these two sub-frames with respect to each other.

The hitching sub-frame 7 comprises a pair of longitudinally extending, L-shaped frame members 13, 13' that extend parallel each in a vertical plane and are rigidly connected to each other by means of transversal frame members 15, 15', 15'' (see FIG. 4). These L-shaped frame members 13, 13' have horizontal arms 17, 17' that are rearwardly oriented. These arms 17, 17' that together define the rear portion of the hitching sub-frame 7, are bent toward each other at the rear end 19 of the hitching sub-frame 7 to give a V-shape to this rear end.

The L-shaped frame members 13, 13' also have vertical arms 19, 19' that projects vertically at the front end of the rear portion of the hitching sub-frame 7 and, these arms 19, 19' together defining the front portion of the sub-frame 7.

The rear portion of the hitching sub-frame 7 includes longitudinally spaced-apart, front and rear hitching means detachably connectable to the bottom of the vehicle frame 5.

Figure 5:
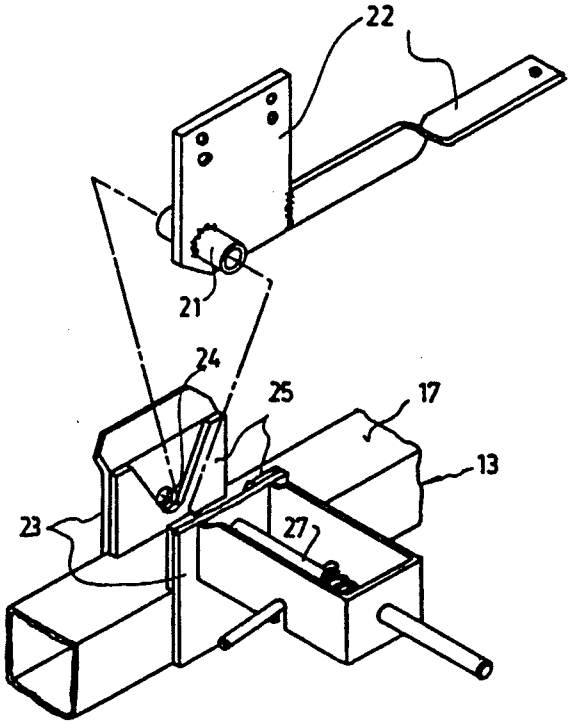
FIG. 5 is a perspective view of the front hitching means.
Figure 7:
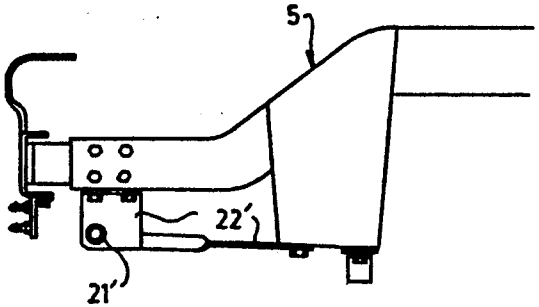
FIG. 7 is a side elevational view of portions of the hitching means fixed to the vehicle frame.

As better shown in FIGS. 5 and 7, the front hitching means comprises a pair of transversally extending, coaxially positioned, pin-receiving tubings 21, 21' fixed by means of plates 22, 22' to the frame 5 of the vehicle under the same, so as to extend above the horizontal arms 17, 17' of the L-shaped frame members 13, 13' when the hitching sub-frame 7 is longitudinally positioned in hitching position under the vehicle frame.

The front hitching means also comprises a pair of longitudinally extending cheek plates 23, 23' vertically projecting from each of the horizontal arms 17, 17' of the L-shaped frame members 13, 13'. Each pair of cheek plates, say those numbered 23, is perforated by transversal hole 24 and forms a longitudinal yoke in which one of the tubings, say 21, may transversally engage as is shown in FIG. 5. As is also shown in FIGS. 4 and 5, the cheek plates 23, 23' of each pair have upper edges that are outwardly flaring, and inner walls that are provided with V-shaped guiding means 25 to allow self-positioning of the corresponding tubing 21 in line with the holes 24 made in the cheek plates.

The front hitching means further comprises a pair of locking pins 27, 27' insertable into the tubings and cheek plates, for pivotably connecting these tubings to their respective cheek plates. As shown in FIGS. 4 and 5, each of the locking pins 27, 27' is preferably a spring biased pin permanently mounted onto the hitching sub-frame 7.

Figure 9:
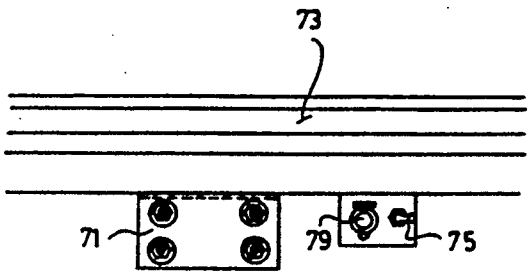
FIG. 9 is a front elevational view of the hydraulic quick coupler and electric switch support fixed to the front of the vehicle.
Figure 8:
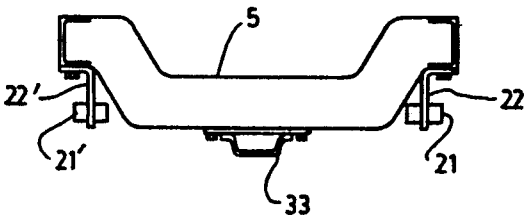
FIG. 8 is a front elevational view of the portion of the rear hitching means fixed to the vehicle frame.

Referring now to FIGS. 4 and 9, the rear hitching means comprise a single spring-biased, rearwardly projecting locking bolt 29 that is centrally positioned and actuable by means of a longitudinal handle 31 that is positioned to be operable from the front end of the hitching frame 5. This bolt 29 is positioned to engage a small, centrally hollowed plate or a loop 33 transversally projecting from the vehicle frame 5 in the middle thereof.

As is shown in FIGS. 2 and 3, the front and rear hitching means disclosed hereinabove are mounted and positioned in such a manner as to allow the hitching sub-frame 7 to be tilted with respect to the vehicle frame 5 about a first transversal axis "X" coaxial with the pins 27, 27' when the front hitching means are connected to the vehicle frame but the rear hitching means is not.

The attachment supporting sub-frame 9 comprises a Δ-shaped frame 35 having a rear base 37 hingedly connected to the front end of the rear position of the hitching sub-frame 7, in front of the front hitching means. The connection is made by a pair of opposite vertical mounting plates 39, 39' and a pair of pivots 41, 41' that are coaxial and form a second transversal axis "Y" parallel to the axis "X" passing through the pins 27, 27'. The pivots 41, 41' vertically connect the mounting plates to the horizontal arms 17, 17' defining the rear portion of the hitching sub-frame 7, close to the front end of this rear portion. The frame 35 of the sub-frame 9 also has an apex 43 to which the snow-blade 3 is pivotably connected about a vertical axis Z, by suitable mounting means known per se.

The attachment supporting sub-frame 9 also comprises a pair of longitudinally extending, auxiliary power jacks 45, 45' symmetrically extending on both sides of the Δ-shaped frame 35, each auxiliary power jack having one end pivotably connected to the Δ-shaped frame and another end pivotably connected to the snow blade 3. In use, these auxiliary power jacks 45, 45' can be actuated either manually or hydraulically from the vehicle V in order to orient the attachment about the vertical axis "Z".

The power jack 11 operatively connecting both sub-frames 7, 9 extends in a longitudinal plane which itself extends vertically centrally with respect to the device 1. This power jack 11 has one end 47 pivotably attached to the front portion of the hitching sub-frame 7 above the second transversal axis Y and another end 49 pivotably attached to the front end 43 of the Δ-shaped frame 35 of the supporting sub-frame 9.

Figure 1:
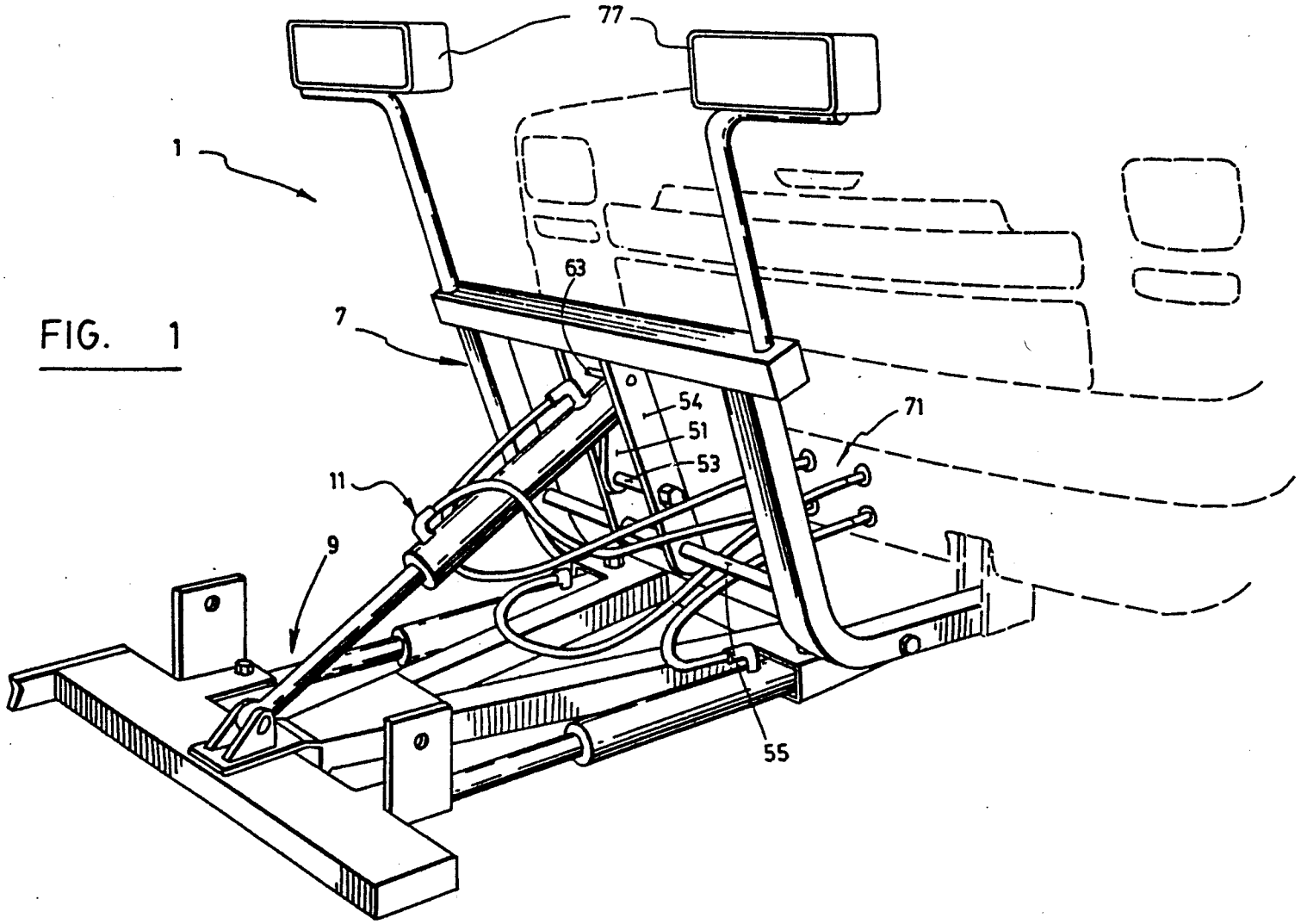
FIG. 1 is a front perspective view of a quick-hitching device according to the invention.
Figure 6:
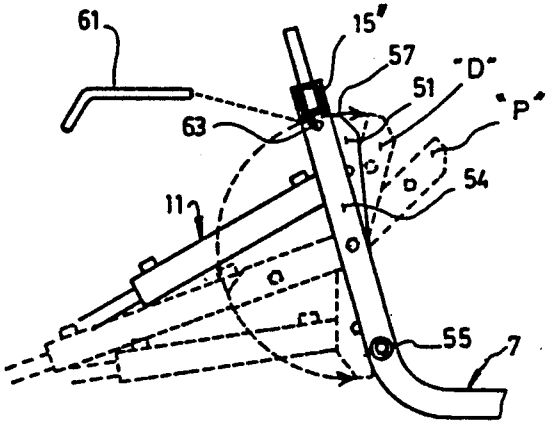
FIG. 6 is a side elevational view of the power jack pivoting mechanism in different positions.

As is better shown in FIGS. 1 and 6, the end 47 of the power jack 11 is pivotably attached to the front portion of the hitching sub-frame 7 via a pivot mechanism including a lever arm 51 consisting of two parallel plates that are movable in unison in the same vertical plane as the power jack 11. The purpose of this lever arm 51 is to increase the stroke of the power jack 51 whenever desired. This arm 51 has one end pivotably connected by a hinge 53 to a pair of vertical plates 54 rigidly mounted between the transversal frame member 15' and a holding bar 55 extending horizontally between the vertical arms 19, 19' of the hitching sub-frame 9 at substantially mid-height thereof. The other end 57 of the lever arm 51 is pivotably connected to the end 47 of the power jack 11.

The holding bar 55 acts as a stopping means to stop the lever arm 51 in a stop position where this lever arm is moved frontwardly downwardly and reaches a downwardly extending position.

Locking means in the form of a manual pin 61 insertable into aligned holes 63 made in the plates 54, are used to lock the lever arm 51 in a lock position where the lever arm extends upwardly rearwardly of the front portion of the hitching sub-frame 7.

As is better shown in FIGS. 2 and 3, the power jack 11 is mounted in such a manner as to cause the supporting sub-frame 9 to be tilted up and down with respect to said hitching sub-frame 7 between a first extreme position shown in FIG. 2 where both sub-frames 7, 9 are folded to form an inverted V, with the second transversal axis extending above the ground and the front hitching means extending up to the frame 5 of the vehicle, and a second extreme position shown in FIG. 3 where the hitching sub-frame 7 is fully connected to the vehicle fame 5 and the supporting sub-frame 9 is tilted up to lift up the attachment 3 mounted thereon in an inactive position. As shown in FIG. 1, the attachment is in active position when the sub-frames are positioned by the power jack 11 between these first and second extreme positions.

In use, positioning of the lever arm 51 in its downwardly extending, stop position where it bears against the stopping means 59 allows the power jack 11 to tilt the hitching and supporting sub-frames up in the first extreme position shown in FIG. 2.

Positioning of the lever arm 51 in its upwardly extending lock position where it extends behind the aligned holes 63 and the locking pin 61 is inserted, allows the hitching and supporting sub-frames to be tilted in the second extreme position shown in FIG. 3, and then the attachment 3 to be tilted between its active and inactive positions.

As can now be better appreciated, the tubings 21, 21' and their mounting plates 22, 22' as well as the loop 33 used to mount the hitching sub-frame 7 to the frame 5 of the vehicle, are entirely mounted under the vehicle at a place where they are not visible from the exterior thereby not disfiguring the vehicle V when the snow plow 3 and its mounting device 1 are removed.

The power jack 11 is preferably hydraulic and operatively connected to a hydraulic power source (not shown) mounted within vehicle. Such a connection can be achieved with quick couplers 71 fixed to the front bumper 73 of the vehicle (see FIGS. 1 and 10). The jack 11 is manually operable from the outside and inside of the vehicle by means of easy-to-reach control means, such as a first switch 75 fixed to the front bumper 73 close to the quick couplers, and a second switch (not shown) located inside the vehicle cabin. The first switch 75 makes it possible for the operator to actuate the device 1 and lift up and lower from the exterior, the hitching sub-frame 7 to attach and detach it from the vehicle.

To mount the device 1, the operator has first to advance over the hitching sub-frame 7 with the vehicle and attach the hoses of the power jack 11 to the hydraulic quick couplers 4.

Then, the lever arm 51 is pivoted downward against the stopping pin 59 and the power jack 11 is actuated to lift up the front portion of the sub-frame 7, while ensuring that the yoke-defining cheek plates 23, 23' are in line with the tubings 21, 21'. The guiding means 25 inside the yoke defining cheek plates 23, 23' will automatically align the tubings with the holes 24, making them ready to be locked with the spring biased locking pins 27, 27' attached to the sub-frame 7.

Then, the operator retracts the power jack 11, thereby causing pivoting of the lever arm 51 to a position where it will be aligned with the power jack 11. In this position, the rod end of power jack 11 will pull up the attachment sub-frame 9 and the hitching sub-frame 7 will rotate about the axis X and be lifted up in a position where its rear end will be ready to be locked with the locking bolt 29. With one hand, the operator may then activate the switch 75 while he lifts with the other hand the lever arm 51 and the power jack 11. When the power jack 11 extends longitudinally, it pushes the lever arm 51 in the up position D shown in FIG. 6, where the locking pin 61 may be inserted into the hole 63 on top of the front portion of the hitching sub-frame 7. In this position D, the snow plow 3 is still on the ground and the lever arms 51 is prevented to move forward, thereby permitting the snow plow 3 to be lift up from the ground. In this position D, the lever arm 51 and power jack 11 are however free to move rearwards to, say, position "P", thereby allowing the snow plow 3 to lift freely up if it encouters a bump.

As is shown in FIG. 1, the quick hitching device 1 may further comprising head lights 77 attached on top of the front portion of the hitching sub-frame 7. These head lights 77 may be connected by a plug to an electric outlet 79 mounted adjacent the switch 75 (see FIG. 10). The head lights 77 are attached onto supporting posts along which they are adjustable in height and angle.

Of course, numerous modification, especially in shape, could be made to the device 1 described hereinabove without departing from the scope of the present invention as defined in the appended claims.

I claim:

1. A quick hitching device for detachably mounting an attachment such as a snow plow to the frame of a road vehicle, said device comprising:

a) a quick hitching sub-frame detachably connectable to the frame of the vehicle, said quick hitching sub-frame having a rear portion including longitudinally spaced-apart front and rear hitching means detachably connectable to the bottom of said vehicle frame, said quick hitching sub-frame being tiltable with respect to said vehicle frame about a first transversal axis when said front hitching means are connected to the vehicle frame but the rear hitching means is not, said hitching sub-frame also having a front portion projecting up vertically in front of said rear portion;

b) an attachment supporting sub-frame having a rear end hingedly connected to the rear portion of the hitching sub-frame, in front of the front hitching means, about a second transversal axis parallel to the first transversal axis, said supporting frame having a front end including means for mounting said attachment; and c) a longitudinal extensible power jack having one end pivotably attached to the front portion of the hitching sub-frame above said second transversal axis and another end pivotably attached to the front end of the supporting sub-frame, said power jack being actuable to cause said supporting sub-frame to be tilted up and down with respect to said hitching sub-frame between a first extreme position where both of said sub-frame are folded to form an inverted V, with the second transversal axis extending above the ground and the front hitching means extending up to the frame of the vehicle, and a second extreme position where the hitching sub-frame is fully connected to the vehicle frame and the supporting sub-frame is tilted up to lift up the attachment mounted thereon in an inactive position, said attachment being in active position between said first and second extreme positions, wherein:

said hitching sub-frame comprises a pair of longitudinally extending, parallel, L-shaped frame members each extending in a vertical plane, said L-shaped frame members being rigidly connected to each other by transversal frame members and having vertical arms that together define said front portion of said hitching sub-frame, and horizontal arms that together define said rear portion of said hitching sub-frame, said rear portion having a front end and a rear end;

said front hitching means comprises:

a pair of transversally extending, pin-receiving tubings fixed under the vehicle frame so as to extend above the horizontal arms of the L-shaped frame members when the hitching sub-frame is longitudinally positioned in hitching position under said vehicle frame, said tubings being coaxial with said first transversal axis;

a pair of longitudinally extending, cheek plates vertically projecting from each of the horizontal arms of the L-shaped frame members, each of said pair of cheek plates having a hole and forming a longitudinal yoke in which one of the tubings may transversally engage; and locking pins insuitable into the tubings and cheek plates for pivotably connecting said tubings to the respective cheek-plates;

said rear hitching means comprise at least one locking bolt actuable from the front end of the rear portion of the hitching sub-frame for detachably connecting the rear end of said rear position to the vehicle frame; and said supporting sub-frame comprises a pair of opposite vertical mounting plates and a pair of pivots coaxial with the second transversal axis for vertically connecting said mounting plates to the horizontal arms defining the rear portion of the hitching sub-frame, close to the front end of said rear portion.

2. The quick hitching device of claim 1, wherein the horizontal arms defining the rear portion of the hitching sub-frame are bent toward each other at the rear of said rear portion to give a V-shape to the rear end of said rear portion, and said rear hitching means comprise a single spring-biased, rearwardly projecting locking bolt actuable by means of a longitudinal handle and positioned to engage a small, centrally hollowed plate transversally projecting from the vehicle frame in the middle thereof.

3. The quick hitching device of claim 1, wherein the cheek plates of each pair have upper edges that are outwardly flaring, and inner walls that are provided with V-shaped guiding means to allow self-positioning of the corresponding tubing with respect to the locking pin-receiving holes in the cheek plates.

4. The quick hitching device of claim 3, wherein each of said locking pins is a spring biased pin permanently mounted onto the hitching sub-frame.

5. The quick hitching device of claim 1, wherein said supporting sub-frame comprises:

a Δ-shaped frame having a rear base pivotably connected to the hitching frame by means of said vertical mounting plates, and a front apex to which said attachment is pivotably connected about a a vertical axis; and a pair of longitudinally extending, auxiliary power jacks symmetrically extending on both sides of the Δ-shaped frame, each of said auxiliary power jack having one end pivotably connected to said Δ-shaped frame and another end pivotably connected to said attachment, said auxiliary power jacks being actuable to orient said attachment about said vertical axis.

6. The quick hitching device of claim 5, wherein said power jack (c) extends in a longitudinal plane that extends vertically centrally with respect to said device; and the one end of said power jack is pivotably attached to the front portion of the hitching sub-frame via a pivot mechanism including:

a lever arm movable in the same vertical plane as said plane jack (c), said lever arm being useful to increase the stroke of the power jack (c) whenever desired, and having one end pivotably connected by a hinge to one of said transversal frame members of the hitching sub-frame, that extends horizontally between the vertical arms defining the front portion of said hitching sub-frame at substantially mid-height thereof, and another end pivotably connected to said one end of the power jack (c);

stopping means fixed to the hitching sub-frame to stop the lever arm in a stop position where said lever arm extends downwardly, positioning of the lever arm in said stop position allowing said hitching and supporting sub-frames to be tilted up in said first extreme position by said power jack (c); and locking means to lock the lever arm in a lock position where said lever arm extends upwardly rearwardly of the front portion of the hitching frame, positioning of said lever arm in said lock position allowing said hitching and supporting sub-frames to be tilted in said second extreme positions and said attachment to be tilted in said active and inactive positions.

7. The quick hitching device of claim 6, wherein the horizontal arms defining the rear portion of the hitching sub-frame are bent toward each other at the rear of said rear portion to give a V-shape to the rear end of said rear portion, and said rear hitching means comprise a single spring-biased, rearwardly projecting locking bolt actuable by means of a longitudinal handle and positioned to engage a small, centrally hollowed plate transversally projecting from the vehicle frame in the middle thereof.

8. The quick hitching device of claim 7, wherein the cheek plates of each pair have upper edges that are outwardly flaring, and inner walls that are provided with V-shaped guiding means to allow self-positioning of the corresponding tubing with respect to the locking pin-receiving holes in the cheek plates.

9. The quick hitching device of claim 8, wherein said power jack (c) is operatively connected to a power source carried out by said vehicle frame, and is manually operable from inside and outside of the vehicle by means of easy-to-reach control means.

10. The quick hitching device of claim 9, wherein the attachment is a snow plow.

11. The quick hitching device of claim 10, further comprising head lights attached on top of the front portion of the hitching sub-frame.

12. The quick hitching device of claim 9, wherein the attachment is a rotating broom.

13. The quick hitching device of claim 1, wherein said power jack (c) extends in a longitudinal plane that extends vertically centrally with respect to said device; and the one end of said power jack is pivotably attached to the front portion of the hitching sub-frame via a pivot mechanism including:

a lever arm movable in the same vertical plane as said power jack (c), said lever arm being useful to increase the stroke of the power jack (c) whenever desired, and having one end pivotably connected by a hinge to one of said transversal frame members of the hitching sub-frame, that extends horizontally between the vertical arms defining the front portion of said hitching sub-frame at substantially mid-height thereof, and another end pivotably connected to said one end of the power jack (c);

stopping means fixed to the hitching sub-frame to stop the lever arm in a stop position where said lever arm extends downwardly, positioning of the lever arm in said stop position allowing said hitching and supporting sub-frames to be tilted up in said first extreme position by said power jack (c); and locking means to lock the lever arm in a lock position where said lever arm extends upwardly rearwardly of the front portion of the hitching frame, positioning of said lever arm in said lock position allowing said hitching and supporting sub-frames to be tilted in said second extreme position and said attachment to be tilted in said active and inactive positions.

* * * * *